US005505665A

United States Patent [19]

Bumstead

[11] Patent Number: 5,505,665

[45] Date of Patent: Apr. 9, 1996

[54] APPARATUS FOR MONITORING GAME CHALLENGES

[76] Inventor: Robert Bumstead, 610, 1710 Radisson Drive S.E., Calgary, Alberta, Canada, T2A 7E9

[21] Appl. No.: 264,520

[22] Filed: Jun. 23, 1994

[51] Int. Cl.[6] ..... A63D 15/20

[52] U.S. Cl. ..... 473/1; 473/27; 273/DIG. 26; 116/222

[58] Field of Search ..... 473/27, 4, 70, 473/1; 273/29 R, 32 R, 460, DIG. 26; 116/222

[56] References Cited

U.S. PATENT DOCUMENTS 5,066,008 11/1991 Rivera ..... 473/4

FOREIGN PATENT DOCUMENTS 419285 3/1991 European Pat. Off. .
2628980 10/1989 France ..... 273/29 R
3329847 2/1985 Germany ..... 273/29 R
3839910 5/1990 Germany .

*Primary Examiner*—Jessica J. Harrison
*Assistant Examiner*—Mark A. Sager
*Attorney, Agent, or Firm*—Anthony R. Lambert

[57] ABSTRACT

An apparatus for monitoring game challenges is described which includes a microprocessor programmed to receive keypad input as to the identity of challengers making challenges and maintain such challenges in a chronological order sequence. A display is provided for visually displaying the identity of the challenger entitled to play in the next challenge match. A keypad is provided for entering the identity of challengers making challenges into the microprocessor. The keypad includes one key dedicated to calling the challenger entitled to play in the next challenge match. Upon the next challenger call key being pressed the system visually displays on the display the identity of the challenger entitled to play in the next challenge match. The keypad also includes one key dedicated to advancing the challenger sequence should the challenger entitled to play in the next challenge match not appear within a reasonable time of his identity being displayed.

9 Claims, 4 Drawing Sheets

APPARATUS FOR MONITORING GAME CHALLENGES

The present invention relates to an apparatus for monitoring game challenges.

BACKGROUND OF THE INVENTION

Games installed in bars and lounges generally operate on a challenge basis. The winner of the previous game plays a challenger from among the bar or lounge patrons. Problems associated with such challenges often leads to disagreements between patrons.

Whenever a disagreement occurs it usually is associated with the system by which challenges are monitored. One system used is that of placing tokens (usually coins) in a row. The placement of the coin both signifies a challengers intent to challenge when it is his turn to do so and also reflects the correct order or sequence of the challenges. Disagreements commonly arise as to who owns which coin and, consequently, who has the right to challenge next. Another system utilizes a chalkboard to record challenges. This system is continually plagued by mislaid chalk, and names that have been mistakenly erased. There is also a human factor, as players who have unsuccessfully completed their challenge sometimes neglect to erase their name from the board.

Another problem associated with monitoring challenges lies in notifying a challenger when it is time for his match. Usually the challenger is a patron of the bar or lounge who is a stranger to the current champion. Without knowledge of who to call, the only mechanism that can be employed is a general paging among the patrons of the bar or lounge. However, bars and lounges can be noisy places so often the page is not heard.

SUMMARY OF THE INVENTION

What is required is an apparatus for monitoring game challenges that will reduce, if not eliminate, disputes.

According to the present invention there is provided an apparatus for monitoring game challenges which includes a microprocessor programmed to receive keypad input as to the identity of challengers making challenges and maintain such challenges in a chronological order sequence. A display is provided for visually displaying the identity of the challenger entitled to play in the next challenge match. A keypad is provided for entering the identity of challengers making challenges into the microprocessor. The keypad includes one key dedicated to calling the challenger entitled to play in the next challenge match. Upon the next challenger call key being pressed the system visually displays on the display the identity of the challenger entitled to play in the next challenge match. The keypad also includes one key dedicated to advancing the challenger sequence should the challenger entitled to play in the next challenge match not appear within a reasonable time of his identity being displayed.

With the apparatus, as described above, the computer serves as a completely impartial judge which maintains the challenge sequence in a correct chronological order. Although beneficial results may be obtained through the use of the apparatus for monitoring challenges, as described, one can never underestimate the human factor where persons accidentally or purposely subvert the system by improperly pressing the advance challenge sequence key. Even more beneficial results may, therefore, be obtained when the advance challenger sequence key is linked to the next challenger call key. When the keys are linked the advance challenger sequence key can only be activated when the next challenger call key has been activated at least once thereby giving the challenger an opportunity to appear.

Although beneficial results may be obtained through the use of the apparatus, as described above, if a challenger is continually made aware of the position of his challenge relative the challenges of others in the challenge sequence there is a greater likelihood the challenger will promptly respond when called upon. Even more beneficial results may, therefore, be obtained when the display visually displays the identities of a plurality of challengers in order of challenge sequence.

Although beneficial result may be obtained through the use of the apparatus, as described above, there is always the possibility that the challenger will be in the washroom or have his back to the display when his identity is displayed to call him. Even more beneficial results may, therefore, be obtained when a supplementary audio tone emitter is linked to the keypad such that an audio tone sounds whenever the next challenger call key is activated. This alerts all challengers to check the standing of their challenge.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
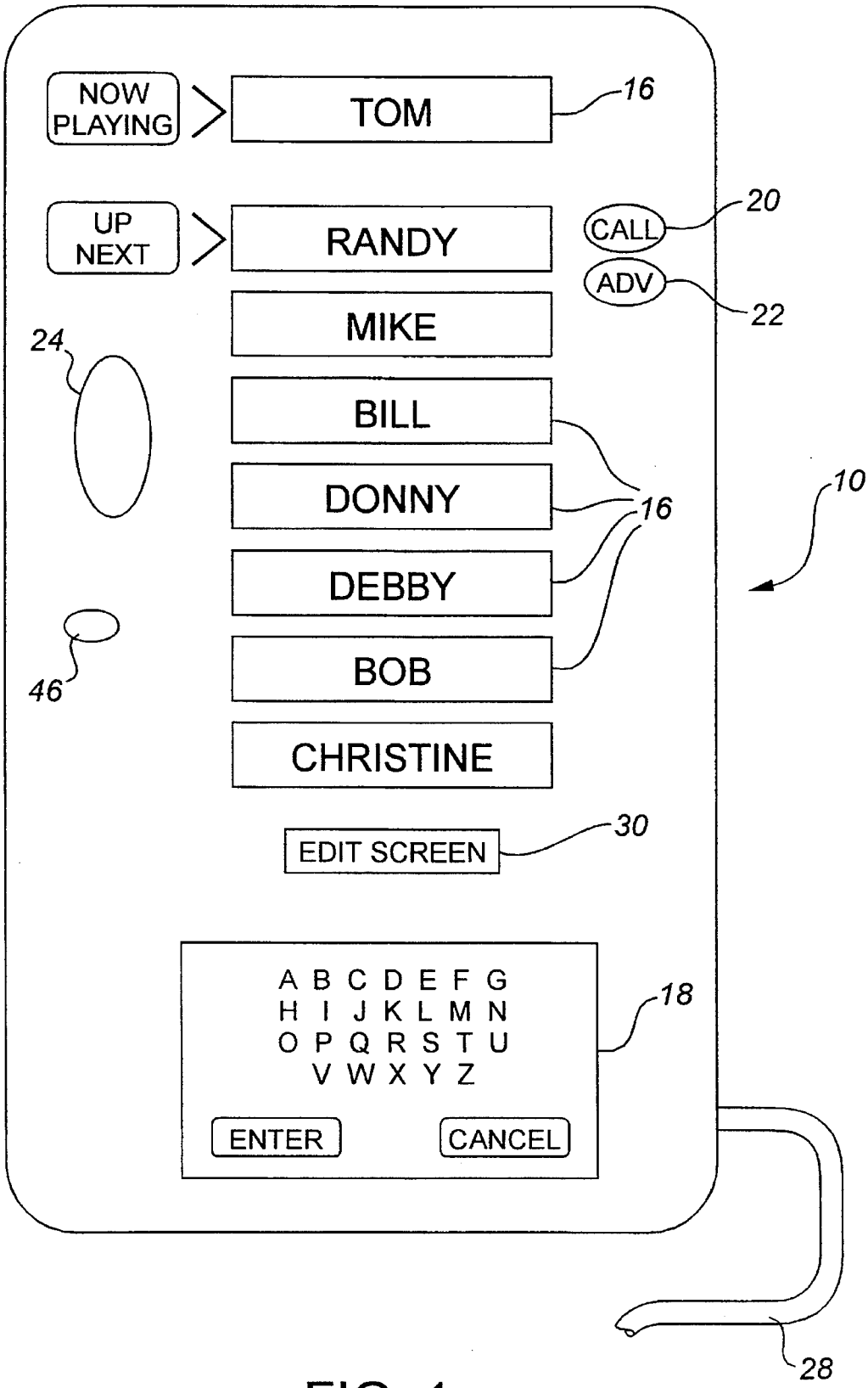
FIG. 1 is a front elevation view of a first embodiment of an apparatus for monitoring game challenges constructed in accordance with the teachings of the present invention.

The preferred embodiment, an apparatus for monitoring game challenges generally identified by reference numeral 10, will now be described with reference to FIGS. 1 through 4.

Figure 2:
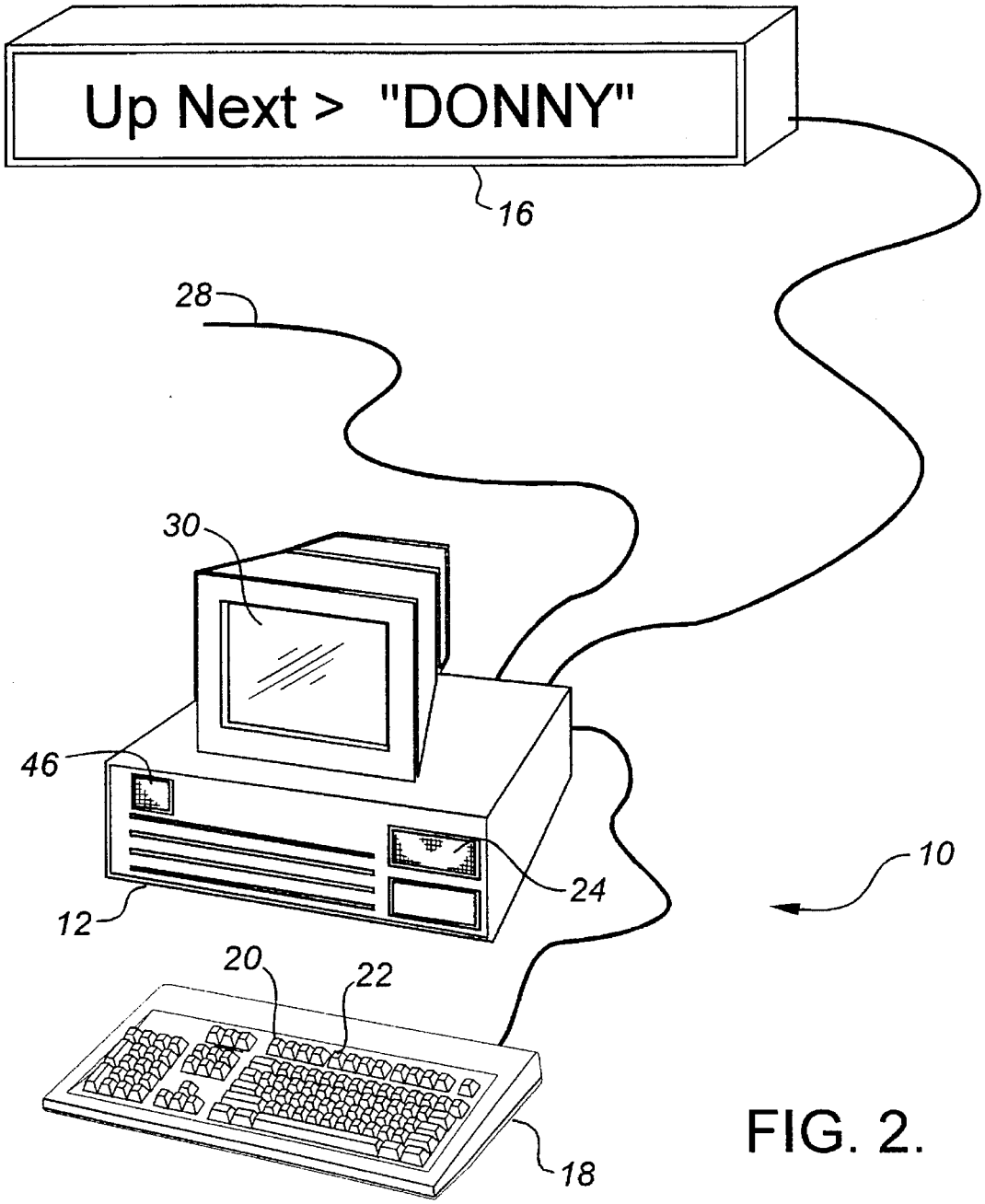
FIG. 2 is a perspective view of a second embodiment of an apparatus for monitoring game challenges constructed in accordance with the teachings of the present invention.

FIG. 2 illustrates apparatus for monitoring game challenges 10 assembled using standard components that are commercially available. Apparatus 10 includes a microprocessor 12. Microprocessor 12 is programmed to receive keypad input as to the identity of challengers making challenges and maintain such challenges in a chronological order sequence. A display 16 is provided to visually display the identity of the challenger entitled to play in the next challenge match, together with the identities of a plurality of the other challengers in order of challenge sequence. Display 16 is a moving display that is intended to be visible throughout the bar or lounge facility serving to widely broadcast the identity of the next challenger. A keypad 18 is provided for entering the identity of challengers making challenges into microprocessor 12. Keypad 18 includes one key 20, styled a "next player call key", dedicated to calling the challenger entitled to play in the next challenge match. Upon next player call key 20 being pressed the system visually displays on display 16 the identity of the challenger entitled to play in the next challenge match. Keypad 18 also includes one key 22, styled an "advance player sequence key", dedicated to advancing the challenger sequence should the challenger entitled to play in the next challenge match not appear within a reasonable time of his identity being displayed. Microprocessor 12 is programmed to link advance player sequence key 22 and next player call key 20. Advance player sequence key 22 can only be activated if next player call key 20 has first been activated at least once, and preferably twice. An audio speaker 24 is linked to next player call key 20 of keypad 18. An audio tone is emitted through audio speaker 24 whenever next player call key 20 is activated. This is intended to alert persons who have their backs to display 16 or are otherwise out of sight of display 16 that a change is taking place in the challenge sequence as displayed on display 16. Technology is available to turn the tone into an audio annunciation of the identity of the challenger entitled to play in the next challenger match, if desired. Display 16 is linked to microprocessor 12 by a data connection cable 26. Microprocessor 12 is also linked by a data connection cable 28 to a coin feed interface (not shown) on a games table. This indirectly links next player call key 20 to the coin feed of the games table. Such a linkage serves several purposes. Firstly, next player call key 20 can only be activated when a coin has been deposited in the coin feed indicating a challenge match is in progress. This prevents accidental advancing of the challenger sequence by inadvertent pressing of next player call key 20. Secondly, the depositing of a coin serves to advance the challenge sequence and it indicates to microprocessor 12 that the next challenge match is in progress.

FIG. 1 which uses the same basic components, indicates how a customized version of apparatus 10 might appear. It should be noted that in the manufacture of a customized version there would be many design alternatives that could be utilized. For example, there are a variety of display technologies, such as liquid crystal display, light emitting diode, cathode ray tube, plasma display, electro mechanical reflective display, etc. Keypad 18 need not be a qwerty style keypad, as only a few basic keys are required.

Figure 3:
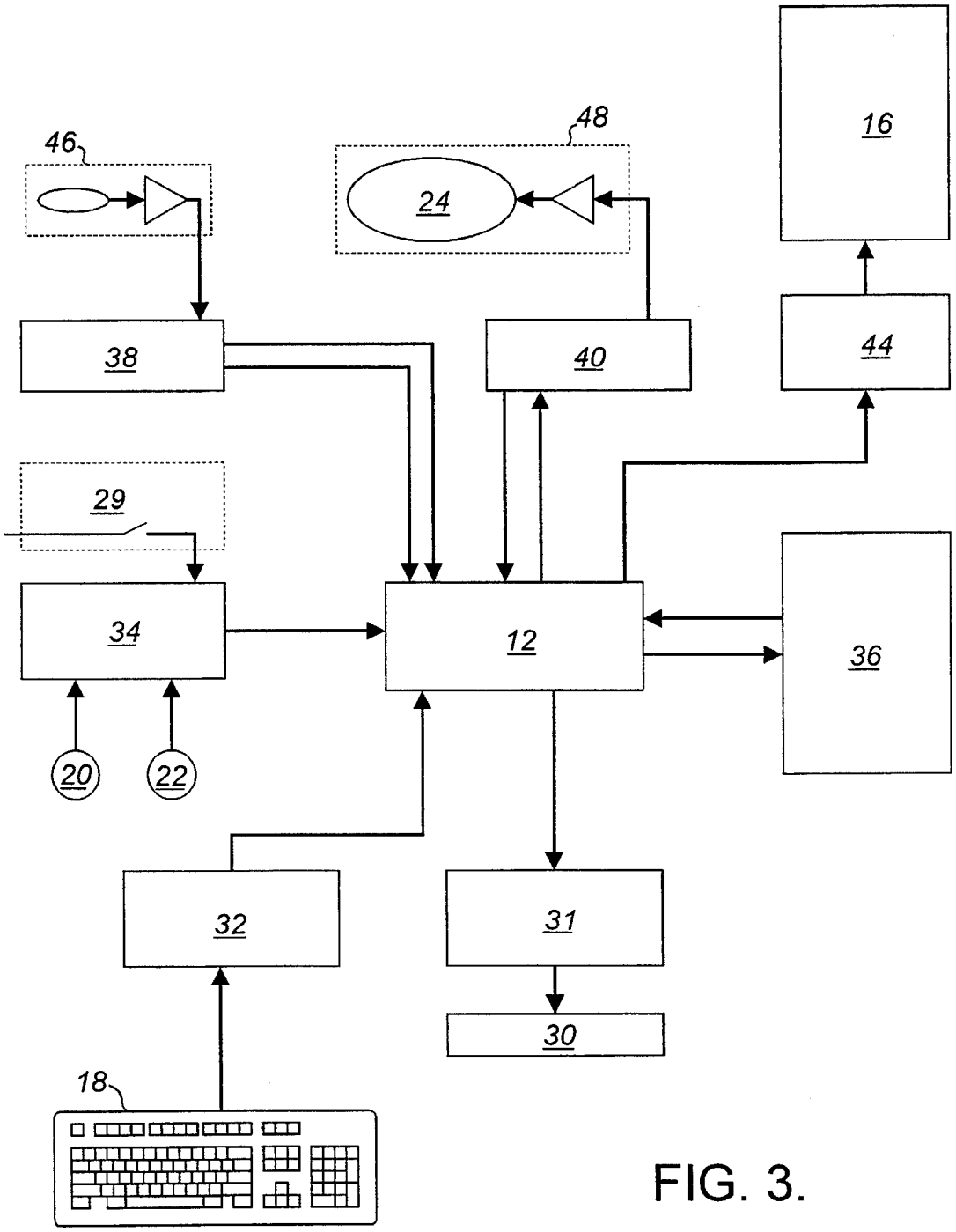
FIG. 3 is a schematic representation of the apparatus for monitoring game challenges illustrated in FIGS. 1 and 2.

FIG. 3 provides a flow chart regarding implementation of the invention. Keypad 18 is a qwerty keyboard, although any alpha numeric keyboard can be used to enter player information. Keypad 18 acts as an interface between challengers and apparatus 10. It is contemplated that there will be a user information and edit screen 30. User information and edit screen 30 provides the challenger with feedback when entering his challenge through qwerty keypad 18. When the user presses a key of keypad 18, user information and edit screen 30 will display the typed character. When an editing function is used by the challenger, the result will be indicated on user information and edit screen 30. Edit and information screen interface 31 accepts signals from microprocessor 12 and translates them into appropriate signals passed onto edit screen 30. Edit screen 30 can accept either serial or parallel data depending upon the components selected. A keypad input control interface 32 is provided between keypad 18 and microprocessor 12. Keypad control interface 32 accepts signals from keypad 18 and translates them into either parallel or serial communication data to microprocessor 12 for processing. Call next player button or Next player call key 20 is a simple push button that allows the user to signal through a digital interface module 34 to microprocessor 12 that the user has requested that a call next challenger sequence be initiated. Microprocessor 12 will determine whether this action is valid, as will hereinafter be further explained in relation to FIG. 4. Advance player or advance player key 22 is a simple push button that allow the user to signal through digital interface module 34 to microprocessor 12 that the user has requested that an advance player sequence be initiated. Central processor unit/Microprocessor 12 will determine whether this action is valid, as will hereinafter be further explained in relation to FIG. 4. Microprocessor 12 is the brains of the system. It controls and arbitrates all actions of the system. It can be a simple microprocessor or an embedded microcontroller of which there are many implementations. The algorithm that microprocessor 12 will process is hereinafter outlined in flow diagram form in FIG. 4. Digital Input interface 34 provides a buffer and signal translation to microprocessor 12. Digital input interface 34 is "digital" in the sense that it is capable of detecting and translating two states such as ON/OFF. Provision is made for memory storage, generally identified by reference numeral 36. Memory storage 36 contains an algorithmic program, as hereinafter described in relation to FIG. 4, which tells how microprocessor 12 arbitrates and controls all actions. This algorithm is coded in the specific language native to and fetched by microprocessor 12 and is often referred to as program memory or ROM (Read Only Memory). In addition to program memory storage contains RAM (Random Access Memory). This memory holds information input by challengers and includes a "challenger queue". The RAM memory thus stores in coded fashion all the challengers names in a sequence queue for later recall as arbitrated by microprocessor 12. In addition to the challenger queue, RAM memory will be required for other operations. Included will be scratch pad memory, display memory, edit screen memory, and digitized audio memory. Scratch pad memory is the miscellaneous memory required for programming parameters and comparison flags. This is where math calculations and other processing functions take place. Display memory holds that portion of the challenger queue that is written to the displays. This memory is smaller than the memory required for the overall queue, as not all of the challenger queue will be displayed. Edit screen memory holds prompts and edit instructions for the user when entering a challenge. Digitized audio memory is a system option in which a digitized recording of each name in the challenger queue may be stored. Analog audio recording techniques can, alternatively, be implemented. In such cases the audio memory can be in the form of a magnetic tape, or analog semiconductor recording. In any case, some type of memory media is required to retain the audio sampled data. An Analog to Digital Converter 38 may optionally be used to record audio voice data and store it in digital form. The digital data is then passed to microprocessor 12 where it is stored in memory 36 for later recall and playback. Analog to Digital Converter 38 may be replaced by analog recording technology as previously mentioned. When Analog to Digital Converter 38 is used, there is also used a Digital to Analog Converter 40. Digital to Analog Converter 40 receives digital information and control signals from microprocessor 12 and converts such digital information back into analog signals. These analog signals are then passed to an amplifier, where they are delivered by sound speaker 24 to announce the "next up" challenger. A next up and next sequence display interface 44 receives either parallel or serial data and control signals from microprocessor 12. Microprocessor 12 fetches the applicable name from the challenger queue and display interface 44 converts this data into the appropriate signals for display 16. An optional microphone interface circuit 46 accepts analog "voice" data. The data is amplified and buffered, as required, and passed onto Analog to Digital Converter 38. This enables the name of the "next up" challenger to be recorded for later broadcast over speakers which form part of speaker/audio drive circuit 48. Speaker/audio drive circuit 48 accepts analog signals from digital to analog converter 40. The analog data is amplified by this circuit and sent to a speaker that provides audio sound. Optionally, this circuit can include a line out interface that will allow the interface of an external high powered amplifier or distributed public address system. Display board 16 displays portions of the challenger queue.

Figure 4:
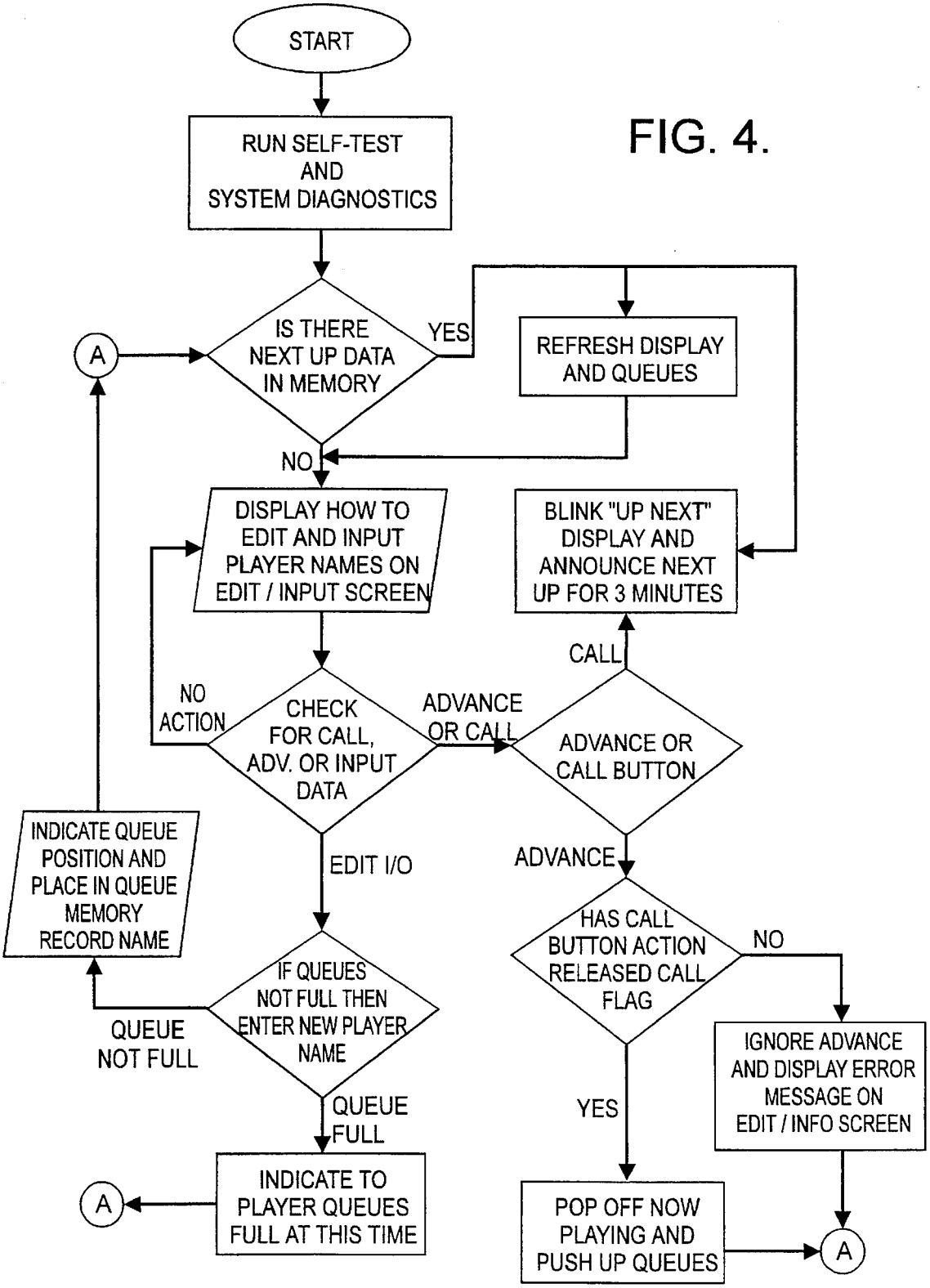
FIG. 4 is an operational flowchart of the apparatus for monitoring game challenges illustrated in FIGS. 1 and 2.

The logic of the algorithmic program will now be described with reference to FIG. 4. Apparatus 10 is start or reset by powering on the system or initiating a reset sequence. The system will perform a number of self test diagnostics and indicate the results on edit screen 30. If a failure is indicated, a failure code will be displayed. This code is then available to facilitate service or repair. If the system has been interrupted via a power down or power failure, the system will look for memory preserved in the queue. If there is "valid" queue data, then the system will refresh all the applicable displays, index to the next appropriate queue position and wait for new data/instructions. If this is the first initialization or there is no input from keypad 18, then the system will immediately begin prompting for user input queue information via user information and edit screen 30. When the system detects key presses on keypad 18, it will check to see if the queues are full. If the queues are full, user information and edit screen 30 will indicate to the user that the queue is full and please return later. If the queue is not full, then the system will accept a new queue name and provide interactive editing features. Upon next player call key 20 being pressed or input via data connection cable 28 from the coin feed interface the system will advance the queue. When the queue is advanced the appropriate "next up" display appears and an audio tone sounds. The audio tone may, optionally, be in the form of an audio announcement feature in which the name of the next challenger is announced. If advance player key 22 is pressed, the system will check to see if next player call key 20 has been pressed. The system will not allow the advance player key 22 to advance the queue positions unless the next player call key 20 has been activated for a preset period, for example three minutes, and the challenger has not come forward to commence the challenge. If the pressing of advance player key 22 has not been preceded for the preset time by the pressing of the next player call key 20, the advance call action will be ignored and an error message will appear on user information and edit screen 30. If the preset time period has elapsed, the system will advance all the queue positions by one and change the now playing display position. This empties the queue memory by one. The revised challenger queue will then be displayed on display 16 accompanied by an audio tone.

It will be apparent to one skilled in the art that modifications may be made to the illustrated embodiment without departing from the spirit and scope of the invention as defined by the claims.

The embodiments of the invention in which an exclusive property or privilege is claimed are as follows:

1. An apparatus for monitoring game challenges, comprising:

a. a microprocessor programmed to receive keypad input as to the identity of challengers making challenges and maintain such challenges in a chronologically ordered challenge sequence;

b. a display for visually displaying the identity of the challenger entitled to play in a next challenge match; and c. a keypad for entering into the microprocessor data identifying challengers making challenges, the keypad including a next challenger call key dedicated to calling the challenger entitled to play in the next challenge match such that upon the next challenger call key being pressed the display visually displays the identity of the challenger entitled to play in the next challenge match.

2. The apparatus for monitoring game challenges as defined in claim 1, the keypad including an advance challenger sequence key dedicated to sequentially advancing the challenger sequence should the challenger entitled to play in the next challenge match not appear within a preset time of his identity being displayed.

3. The apparatus for monitoring game challenges as defined in claim 2, wherein a precondition to the microprocessor accepting keypad input from the advance challenger sequence key is the next challenger call key having been activated at least once to call the challenger identified as entitled to play in the next challenge match.

4. The apparatus for monitoring game challenges as defined in claim 1, wherein the next challenger call key is linked to a coin box of a game and a precondition to the microprocessor accepting keypad input from the next challenger call key is a coin having been deposited in the coin box indicating a challenge match is in progress.

5. The apparatus for monitoring game challenges as defined in claim 1, wherein the display visually displays the identities of a plurality of challengers in order of the challenge sequence.

6. The apparatus for monitoring game challenges as defined in claim 1, wherein an audio tone sounds whenever the next challenger call key is activated.

7. The apparatus for monitoring game challenges as defined in claim 6, wherein the audio tone is in the form of an audio annunciation of the identity of the challenger entitled to play in the next challenger match.

8. An apparatus for monitoring game challenges, comprising:

a. a microprocessor programmed to receive keypad input as to the identity of challengers making challenges and maintain such challenges in a chronologically ordered challenge sequence;

b. a display for visually displaying the identity of the challenger entitled to play in a next challenge match, together with the identities of a plurality of the other challengers in order of challenge sequence;

c. a keypad for entering the identity of challengers making challenges into the microprocessor, the keypad including a next challenger call key dedicated to calling the challenger entitled to play in the next challenge match such that upon the next challenger call key being pressed the display visually displays the identity of the challenger entitled to play in the next challenge match, the keypad including an advance challenger sequence key dedicated to sequentially advancing the challenger sequence should the challenger entitled to play in the next challenge match not appear within a preset time of his identity being displayed, the microprocessor being programmed to link the advance challenger sequence key and the next challenger call key such that a precondition to the microprocessor accepting keypad input from the advance challenger sequence key is the next challenger call key having been activated at least once to call the challenger identified as entitled to play in the next challenge match; and d. an audio tone emitter linked to the keypad such that an audio tone sounds whenever the next challenger call key is activated.

9. The apparatus for monitoring game challenges as defined in claim 8, wherein the tone is in the form an audio annunciation of the identity of the challenger entitled to play in the next challenger match.

* * * * *